US006973684B2

(12) United States Patent
Yoo

(10) Patent No.: US 6,973,684 B2
(45) Date of Patent: Dec. 13, 2005

(54) WASHSTAND HEIGHT-ADJUSTING APPARATUS

(75) Inventor: Jae-Hyeong Yoo, Seoul (KR)

(73) Assignee: Kwanbo Tech Co., Ltd., Seoul (KR)

( * ) Notice: Subject to any disclaimer, the term of this patent is extended or adjusted under 35 U.S.C. 154(b) by 27 days.

(21) Appl. No.: 10/478,280

(22) PCT Filed: May 7, 2002

(86) PCT No.: PCT/KR02/00844

§ 371 (c)(1),
(2), (4) Date: Apr. 21, 2004

(87) PCT Pub. No.: WO02/094072

PCT Pub. Date: Nov. 28, 2002

(65) Prior Publication Data

US 2004/0168250 A1 Sep. 2, 2004

(30) Foreign Application Priority Data

May 18, 2001 (KR) ..... 2001-0027198

(51) Int. Cl.[7] ..... A47K 1/05
(52) U.S. Cl. ..... 4/645
(58) Field of Search ..... 4/645; 248/132

(56) References Cited

U.S. PATENT DOCUMENTS 5,628,075 A * 5/1997 Dudnik et al. ..... 4/645
6,477,725 B1 * 11/2002 Hong et al. ..... 4/645

FOREIGN PATENT DOCUMENTS

| | | |
|---|---|---|
| JP | 08-089427 | 4/1996 |
| JP | 11-206595 | 8/1999 |
| JP | 2000-152887 | 6/2000 |
| KR | 1986-0013420 | 11/1986 |
| KR | 1999-0040515 | 12/1999 |

* cited by examiner

*Primary Examiner*—Charles E. Phillips
(74) *Attorney, Agent, or Firm*—Ladas & Parry LLP

(57) ABSTRACT

The present invention relates to a washstand height-adjusting apparatus that can freely adjust the height of a washstand for convenience of a user. The washstand height-adjustment apparatus according to the present invention comprises a fixed guide fixed to a wall; a moving guide combined with the fixed guide to slidably move in a vertical direction; a cover plate to which a washstand with a drainpipe and pipes for supplying cool and hot water is mounted, wherein the cover plate is fixed to the moving guide; and a driving means installed at the upper portion of the fixed guide and coupled to the lower portion of the cover plate. Therefore, the cover plate and the washstand are moved upward or downward by operation of the driving means. According to the present invention, a tall or small person, particularly a child, can freely adjust the height of the washstand to fit it to his physical feature so that he can conveniently use the washstand without strain on the user's waist. Also, there is no need to use an auxiliary means for a small person or child to meet the height of a washstand, and thus possible accidents by the auxiliary means can be prevented.

3 Claims, 5 Drawing Sheets

WASHSTAND HEIGHT-ADJUSTING APPARATUS

TECHNICAL FIELD

The present invention relates to an apparatus for adjusting the height of a washstand and, more particularly, to a washstand height-adjusting apparatus that can freely adjust the height of a washstand for convenience of a user.

BACKGROUND ART

In general, a washstand is installed and fixed at a certain height, and so the height of a washstand cannot be freely adjusted according to a user's stature.

A user with a stature suitable for using a washstand with a fixed height conveniently uses the washstand. However, a taller or smaller person than the height of a washstand experiences inconvenience in using the washstand. That is, a taller person than the height of a washstand should inconveniently stoop over or down whenever he uses the washstand. Frequent stooping over or down can cause pain in the back, and a purse or coins in a pocket of an upper garment can come out of the pocket.

In contrary to the case described above, when a smaller person or child than the height of a washstand uses the washstand, the user should stretch his back since the height of the washstand is higher than the stature of the user so that the user's clothes usually get wet in water. Also, when the user stands on an auxiliary means to meet the height of the washstand, the user may slip and fall from the auxiliary means and be wounded.

DISCLOSURE OF THE INVENTION

The present invention has been invented in order to solve the above-mentioned problems encountered in using a conventional washstand. An object of the present invention is to provide a washstand height-adjusting apparatus that can freely adjust the height of a washstand for convenience of a user.

To achieve the above object, a washstand height-adjusting apparatus according to the present invention comprises a fixed guide fixed to a wall; a moving guide combined with the fixed guide to slidably move in a vertical direction; a cover plate to which a washstand with a drain pipe and pipes for supplying cool and hot water is mounted, the cover plate being fixed to the moving guide; and a driving means installed at the upper portion of the fixed guide, and the driving means being coupled to the lower portion of the cover plate. The cover plate and the washstand are moved upward or downward according to an operation of the driving means.

The driving means of the washstand height-adjusting apparatus according to the present invention comprises a motor connected to a switch means; a pulley meshed with gears being coupled to a shaft of the motor; and a wire on which gears are formed for meshing with the pulley. One end of the wire is fixed to the pulley and the other end is connected to the lower portion of the cover plate. Therefore, the wire is wound around the pulley or released from the pulley according a rotating direction of the pulley.

The washstand height-adjusting apparatus of the present invention further comprises lead switches installed on the upper and lower portions of the moving guide, respectively, and connected to the driving means for restricting excessive movement of the cover plate; magnetic bodies installed on the upper and lower portions of the cover plate, respectively, whereby the lead switches control operation of the driving means when the cover plate reaches to the upper limit or the lower limit so that the cover plate can move within the restricted range.

According to the present invention, a taller or smaller person, particularly a child and a physically handicapped person, can freely adjust the height of the washstand to fit one's physical feature so that the user can conveniently use the washstand without strain on the user's waist. Also, there is no need to use an auxiliary means for a small person or child to fit the height of a washstand to his stature, and thus possible accidents caused by the auxiliary means may be prevented.

BRIEF DESCRIPTION OF THE DRAWINGS

The objects, features and advantages of the present invention will be more clearly understood from the following detailed description in conjunction with the accompanying drawings, in which.

BEST MODE FOR CARRYING OUT THE INVENTION

Figure 1:
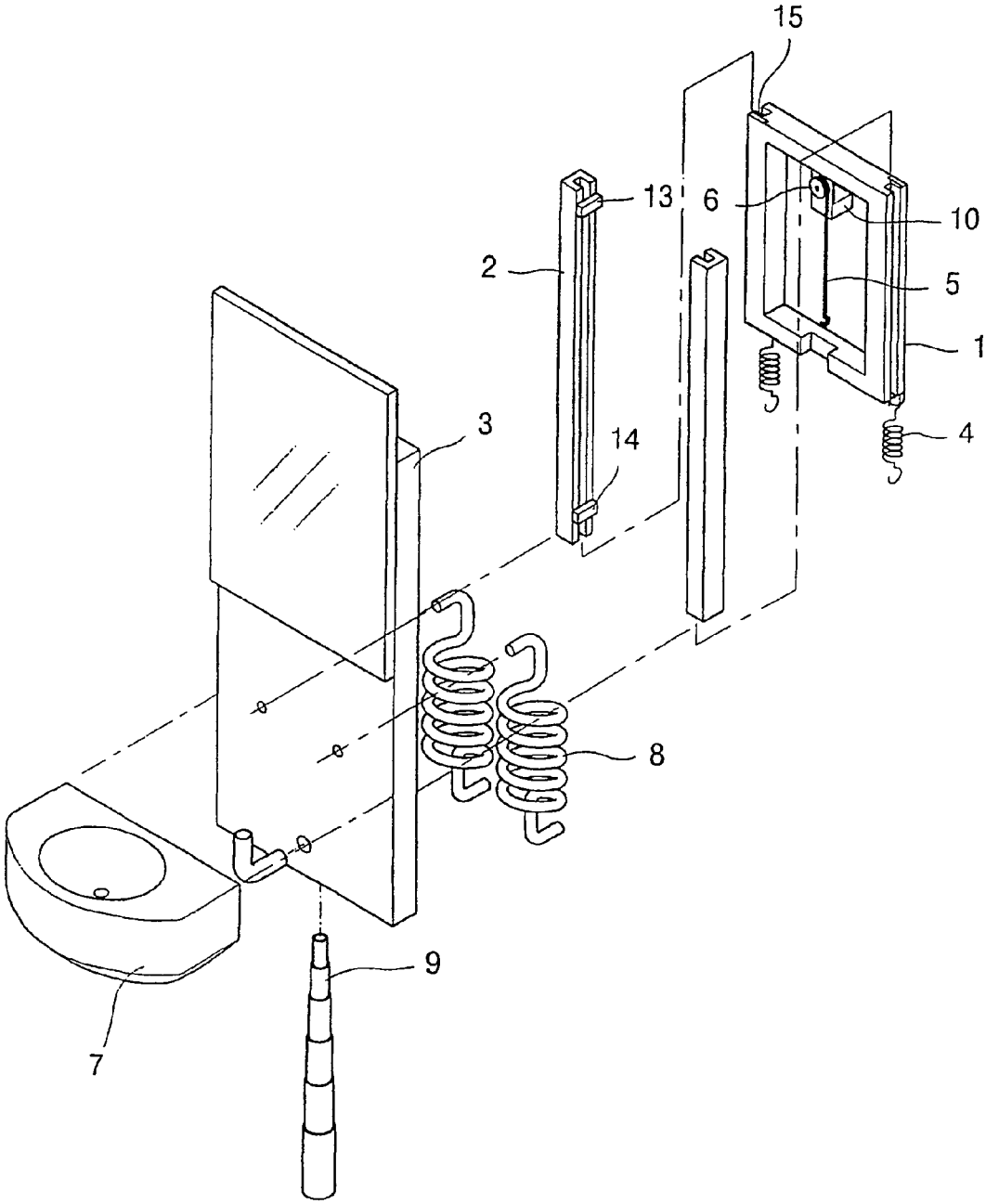
FIG. 1 is a disassembled perspective view of the washstand height-adjusting apparatus in accordance with the present invention.

Reference now should be made to the drawings, in which the same reference numerals are used throughout the different drawings to indicate the same or similar components.

Figure 2:
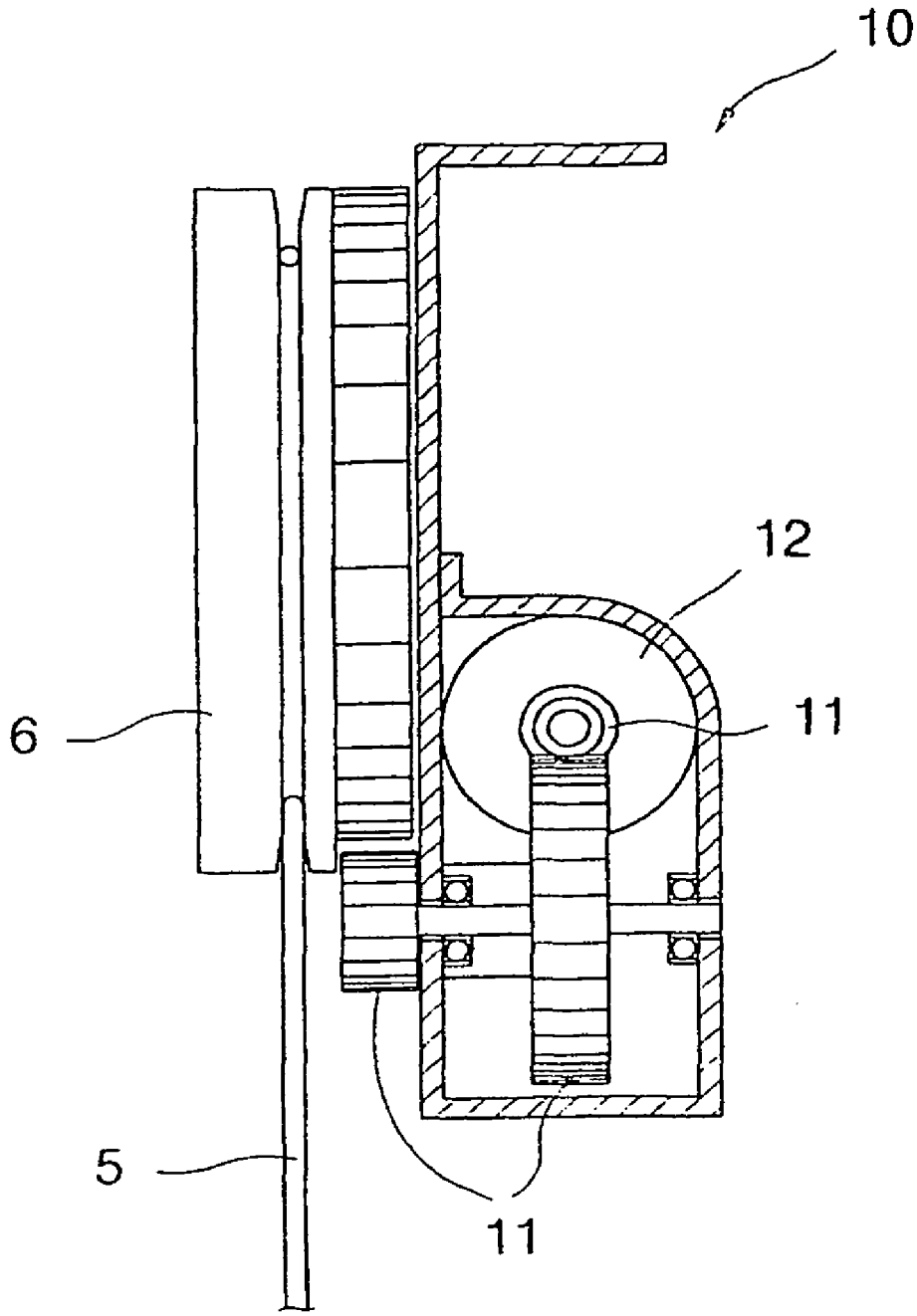
FIG. 2 is a sectional view showing a driving means of the washstand height-adjusting apparatus in accordance with the present invention.
Figure 3:
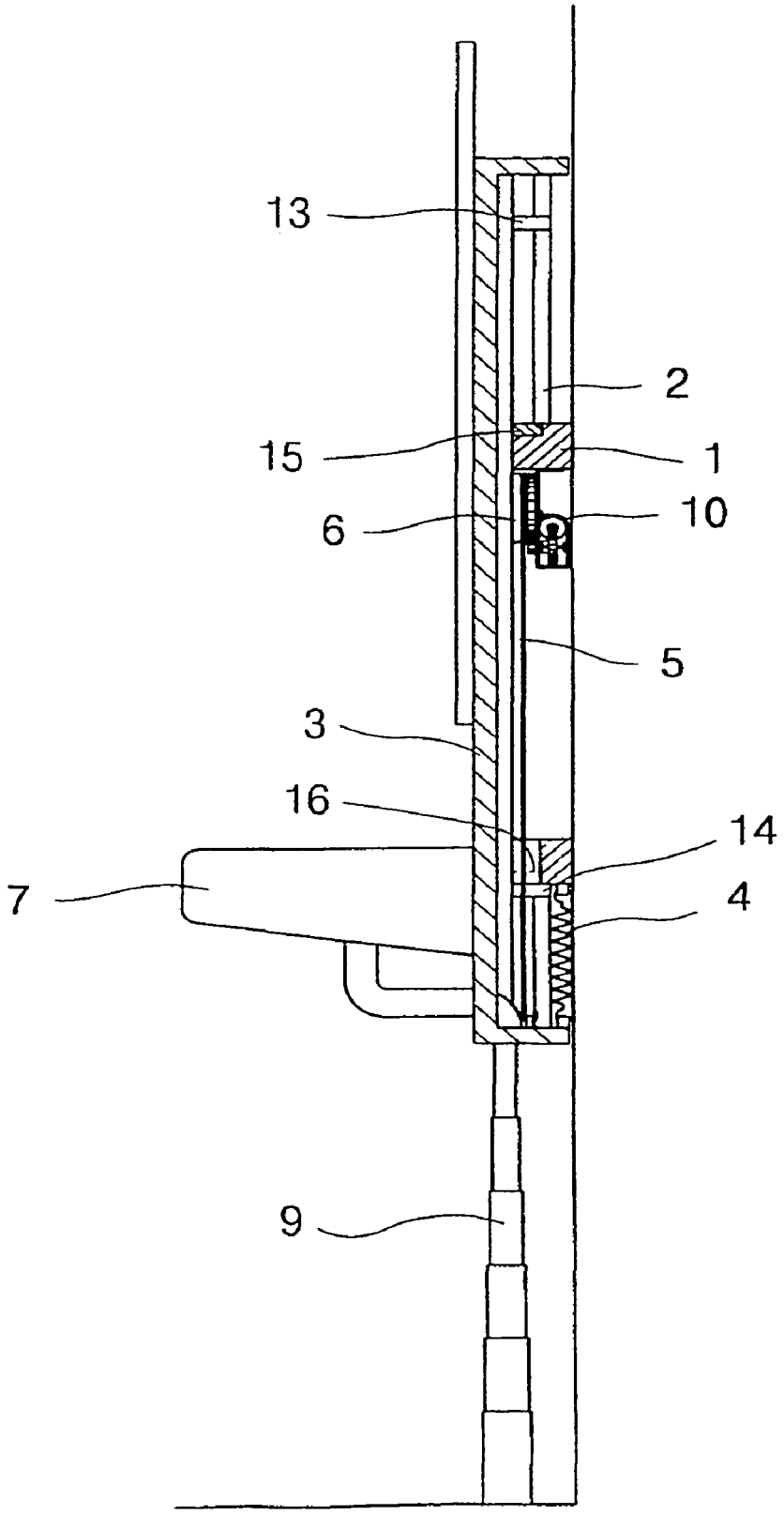
FIG. 3 is a view for explaining operation of the washstand height-adjusting apparatus in accordance with the present invention to show a position that the washstand is moved upward.
Figure 4:
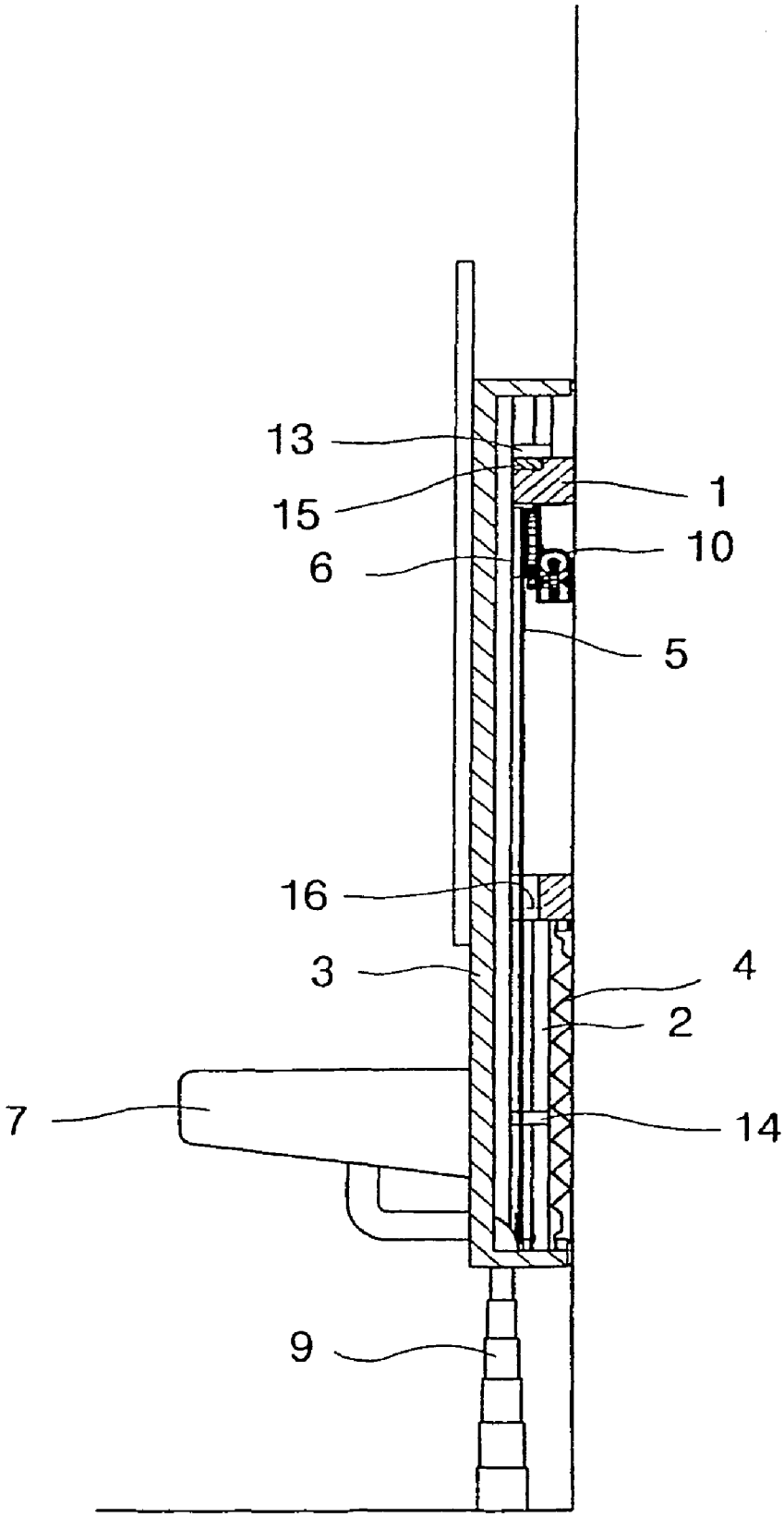
FIG. 4 is a view for explaining operation of the washstand height-adjusting apparatus in accordance with the present invention to show a position that the washstand is moved downward.
Figure 5:
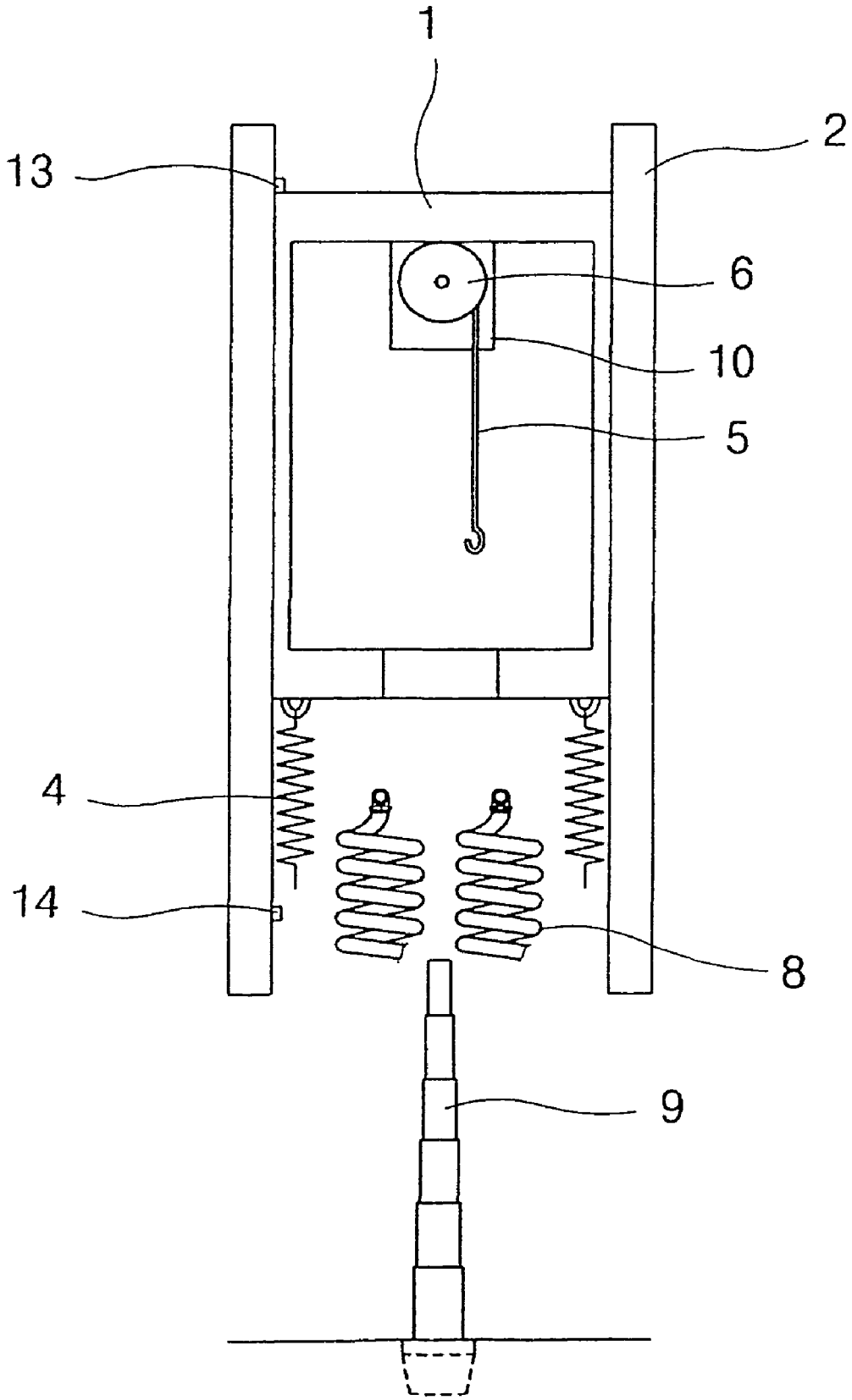
FIG. 5 is a front view in which the cover plate of the present invention is removed.

FIG. 1 is a disassembled perspective view of the washstand height-adjusting apparatus in accordance with the present invention; FIG. 2 is a sectional view showing a driving means of the washstand height-adjusting apparatus in accordance with the present invention; FIG. 3 is a view for explaining operation of the washstand height-adjusting apparatus in accordance with the present invention to show a position that the washstand is moved upward; and FIG. 4 is a view for explaining operation of the washstand height-adjusting apparatus in accordance with the present invention to show a form that the washstand is moved downward. FIG. 5 is a front view in which the cover plate of the present invention is removed.

In the washstand height-adjusting apparatus in accordance with the present invention, a moving guide 2 is combined to a fixed guide 1 which is fixed to a wall to enable the moving guide 2 to vertically slide along the fixed guide 1. A cover plate 3 is fixed and combined to the moving guide 2 so that the moving guide 2 cannot be separated from the fixed guide 1.

The lower portion of the fixed guide 1 is coupled to the lower portion of the cover plate 3 via springs 4, a driving means 10 having a pulley 6 for winding a wire 5 is installed in the fixed guide 1. The wire 5 is connected to the pulley 6 and wound around the pulley 6. The end of the wire 5 is connected to the lower portion of the cover plate 3 so that the cover plate 3 can be vertically moved by operation of the driving means 10 and a spring 4. An upper lead switch 13 is mounted to the upper portion of the moving guide 2, and a lower lead switch 14 is mounted to the lower portion of the moving guide 2. Magnetic bodies 15 and 16 are under the upper and lower portions of the fixed guide 1, respectively. Magnetic bodies 15 and 16 contact the upper and lower lead switches 13 and 14, respectively, when the moving guide 2 is vertically moved. Therefore, the vertical height of the cover plate 3 can be restricted by operation of the lead switches 13 and 14 due to magnetic bodies 15 and 16.

At the rear side of the cover plate 3, pipes for supplying cold and hot water are installed using coil pipes 8 at a position to which the washstand 7 will be attached. The washstand 7 is combined and fixed to the cover plate 3. The ends of the coil pipes 8 are coupled to the taps for cold and hot water, which are already mounted to the washstand 7. An antenna-type drainpipe 9 is connected to a drain port of the washstand 7. Also, a mirror or a cabinet may be attached to the upper portion of the cover plate 3.

The driving means 10 comprises the wire 5 on which a gear is formed, the pulley 6 around which the wire 5 is wound, a plurality of gears 10 meshed with each other, and a motor 12. One of the gears 10 is geared with the pulley 6, and another of the gears 10 is geared with a shaft of the motor 10. Therefore, when a switching means (not shown in the Drawings) is turned on to operate the motor 12, the wire 5 is wound around the pulley 6 or released from the pulley 6. At this time, a conventional switch may be used as the switch means of the invention, but it is more effective to use a speech recognition switch that has been recently developed.

The operational effect of the washstand height-adjusting apparatus in accordance with the present invention will be described herein below.

When a user needs to adjust the height of the washstand, the user turns on the driving means 10 installed in the inner side of the cover plate 3. That is, when the motor 12 of the driving means 10 is operated according to manipulation of the switch means, the gears 11 meshed with the shaft of the motor 12 are rotated, and thus the pulley 6 is rotated.

At this time, although a conventional up-down switch may be used as the switch means, it is more effective to use a speech recognition switch that has been recently developed. The apparatus of the present invention is installed and used in a place where water is used. The speech recognition switch is waterproofed and may be fixed to the inner surface of the cover plate 3 to improve the appearance and the waterproof effect. In this way, trouble of the switch due to water can be prevented.

When the motor 12 and the gear 11 rotates the pulley 6, the wire 5 is wound around or released from the pulley 6 so that the cover plate 3 is moved upward or downward.

When a user selects the "up" mode of the switch means to move the cover plate 3 upwardly, the motor 12 of the driving means 10 is operated. The rotational force of the motor 12 is transmitted to and reduced by the gears 11. Then, the reduced rotational force is transmitted to the pulley 6 to rotate it. Thus, the wire 5 is wound around the rotating pulley 6. When the wire 5 is wound around the pulley 6, the cover plate 3 is moved upward due to the wire 5, and the moving guide 2 fixed to the cover plate 3 is slid upward along the fixed guide 1. At this time, the resilient force of the springs 4 fixed between the lower portion of the fixed guide 1 and the lower portion of the cover plate 3 assists smooth upward movement of the cover plate 3.

When the washstand 7 reaches a desired height, the user controls the switch means to halt an operation of the motor 12 of the driving means 10, thus the rotation of the gears 11 and the pulley 6 is stopped and the upward movement of the washstand 7 is stopped (see FIG. 3). At this time, since the wire 5 on which the gear is formed is meshed with the pulley 6, the wire 5 wound around pulley 6 cannot be released from the pulley 6 though the pulley 6 is not rotated.

Although the washstand 7 reaches the upper limit, the washstand 7 is continuously moved upward if a user does not control the switch means. The lead switch 14 is used as a safety device to prevent safety accidents. When the washstand 7 reaches the upper limit, the lead switch 14 installed at the lower portion of the moving guide 2 comes close to the magnetic body 16 located at the lower portion of the fixed guide 1, and thus the lead switch 14 is operated. The power supplied to the driving means 10 is stopped due to operation of the lead switch 14 and the motor 12 is not operated so that the pulley 6 is not rotated and the upward movement of the washstand 7 is halted.

When a user selects the "down" mode of the switch means to move the cover plate 3 downwardly, the motor 12 of the driving means 10 is reversely operated. The rotational force of the motor 12 is transmitted to the gears 11 and is reduced by the gears. Then, the reduced rotational force is transmitted to the pulley 6 to rotate the pulley 6 to the opposite rotating direction of the pulley 6 when the cover plate 3 is moved upward. Then, the wound wire 5 is released from the rotating pulley 6. When the wire 5 is released from the pulley 6, the cover plate 3, the moving guide 2, and the washstand 7 are moved downward due to their weights. The moving guide 2 fixed to the cover plate 3 is slid downward along the fixed guide 1 by release of the wire 5 and reaction force of the spring 4 fixed between the lower portion of the fixed guide 1 and the lower portion of the cover plate 3.

When the washstand 7 reaches a desired height, the user controls the switch means to halt operation of the motor 12 of the driving means 10, and so the rotation of the gears 11 and the pulley 6 is stopped and the downward movement of the washstand 7 is stopped (see FIG. 4).

Although the washstand 7 reaches the lower limit, the washstand 7 is continuously moved downward if a user does not control the switch means. The present invention uses the lead switch 13 as a safety device to prevent safety accidents. When the washstand 7 reaches the lower limit, the lead switch 13 installed at the upper portion of the moving guide 2 comes close to the magnetic body 15 located at the upper portion of the fixed guide 1, and thus the lead switch 13 is operated. The power supplied to the driving means 10 is stopped due to operation of the lead switch 13 and the motor 12 is not operated so that the pulley 6 is not rotated and the downward movement of the washstand 7 is halted.

Also, when the cover plate 3 is moved upward or downward, the spring 4 connecting the lower portion of the fixed guide 1 to the lower portion of the cover plate 3 performs a complementary role to enable the cover plate 3 to smoothly move downward or upward by the nature of the spring 4.

Moreover, since the coil pipes 8 are used as the pipes for supplying cold and hot water, the coil pipes 6 are extended or shrunk when the washstand 7 is moved upward or downward so that the upward and downward movement of the washstand 7 is not affected by the coil pipes 8. Also, since the antenna-type drainpipe 9 is used as a drainpipe, the antenna-type drainpipe 9 is extended when the washstand 7 is moved upward. On the contrary, when the washstand 7 is moved downward, the antenna-type drainpipe 9 is retracted.

According to the present invention as described above, a taller or smaller person, especially a child and a physically handicapped person, can adjust freely the height of the washstand to fit it to his physical feature so that he can conveniently use the washstand without strain on the user's waist. Also, there is no need to use an auxiliary means for a small person or child to fit his stature to the height of the washstand, and thus possible accidents by an auxiliary means may be prevented.

Although the preferred embodiment of the present invention has been described for illustrative purposes, those skilled in the art will appreciate that various modifications, additions and substitutions are possible without departing from the scope and core of the present invention as disclosed in the accompanying claims.

What is claimed is:

1. An apparatus for adjusting a height of a washstand, comprising:

a fixed guide fixed to wall;

a moving guide combined with the fixed guide to be slidably moved in a vertical direction;

a cover plate to which a mirror and a washstand having a drain pipe and pipes for supplying a cool water and hot water are mounted, the cover plate being fixed to the moving guide and connected to the fixed guide by a spring for assisting a smooth vertical movement thereof, the pipes for supplying a cool water and hot water being coil pipes and the drain pipe being an antenna type pipe; and a driving means installed on an upper portion of the fixed guide, the driving means comprising a motor connected to a switch means; a pulley meshed with gears being coupled to a shaft of the motor; and a wire being able to wind around the pulley, one end of the wire being fixed to the pulley and another end being connected to a lower portion of the cover plate, whereby the wire is wound around the pulley or released from the pulley according to a rotating direction of the pulley so that the cover plate and the washstand are moved upward or downward in response to an operation of the driving means.

2. The apparatus for adjusting a height of washstand of a claim 1, further comprising;

lead switches installed on an upper and lower portions of the moving guide, respectively, the lead switches being connected to the driving means for restricting an excessive movement of the cover plate; and magnetic bodies installed on an upper and lower portions of the cover plate, respectively, whereby the lead switches control an operation of the driving means when the cover plate reaches to an upper limited point or a lower limited point so that the cover plate can be moved within the restricted range.

3. The apparatus for adjusting a height of washstand of a claim 1, wherein the switch means is an up-down switch or a sound recognition switch.

* * * * *